United States Patent [19]

Lee

[11] Patent Number: 4,574,475

[45] Date of Patent: Mar. 11, 1986

[54] NAIL CLIPPER WITH CUT NAIL RETAINING MEANS

[75] Inventor: Jong B. Lee, Edmonton, Canada

[73] Assignee: James M. Greentree, Alberta, Canada; a part interest

[21] Appl. No.: 645,662

[22] Filed: Aug. 29, 1984

[51] Int. Cl.[4] ..... A45D 29/02

[52] U.S. Cl. ..... 30/28; 30/125

[58] Field of Search ..... 30/28, 124, 125

[56] References Cited

U.S. PATENT DOCUMENTS

| | | | |
|---|---|---|---|
| 1,182,247 | 5/1916 | Buegeleisen | 30/28 |
| 1,702,137 | 2/1929 | Schnefel | 30/28 |
| 2,799,923 | 7/1957 | Senshu | 30/28 |
| 3,316,632 | 5/1967 | Bowers | 30/28 |

*Primary Examiner*—Jimmy C. Peters

*Attorney, Agent, or Firm*—Harvey B. Jacobson

[57] ABSTRACT

A conventional nail clipper construction is provided including a reversible and convertible pivoted lever for displacing a spring-type arm equipped with a first cutting blade portion toward a base plate equipped with a second cutting blade portion. The base plate, however, includes opposite side flanges between which the spring arm is swingable and the opposing surfaces of the spring arm and base plate and the inner sides of the flanges together define a storage area in which nail clippings may be contained when the clipper is not in use. Further, the structure by which the lever is pivotally supported includes coacting portions of the lever and side flanges of the base plate and functions to enable the pivot axis of the lever to be shifted between front and rear limit positions longitudinally of the spring arm and base plate.

9 Claims, 4 Drawing Figures

NAIL CLIPPER WITH CUT NAIL RETAINING MEANS

BACKGROUND OF THE INVENTION

Various forms of nail clippers heretofore have been provided including some nail clippers specifically designed to retain nail clippings. An example of a nail clipping retaining nail clipper including some of the general structural and operational features of the instant invention is disclosed in U.S. Pat. No. 3,744,131. In addition, other nail clippers which are similar in some respects to the nail clipper of the instant invention are disclosed in U.S. Pat. Nos. 1,135,462, 2,960,766, 3,389,462, 4,062,109, 4,117,591 and 4,196,514.

BRIEF DESCRIPTION OF THE INVENTION

The nail clipper of the instant invention is of generally conventional design, but is equipped with opposite side flanges between which the spring arm and lever are operable. The area between the side flanges, the base plate and the spring arm defines a storage area in which nail clippings may be retained when the nail clipper is not in use. In addition, this area serves to catch and retain all nail clippings during a nail clipping operation.

Rather than pivotally mounting the actuating lever of the clipper from a forwardly disposed post carried by the base plate, the lever is pivotally mounted from the side flanges carried by the base plate. In this manner, the nail clipping receiving and retaining area above referred to is maintained totally unobstructed. Still further, the invertible and convertible lever, instead of being post mounted, includes opposite side pivot pin portions which are rotatably and slidably received in opposing longitudinal grooves formed in the side flanges of the base plate. By this construction the actuating lever may be inverted and converted from a second class clipper actuating lever to a first class lever retaining the blade-equipped spring arm in the closed position. Still further, the forward ends of the side flanges carried by the base plate of the clipper include forwardly opening notches formed therein immediately above the opposite ends of the cutting blade member carried by the forward end of the base plate and by this construction the clipper may be used to clip wide toenails which are actually wider than the clipper itself.

The main object of this invention is to provide a nail clipper of improved construction and which will be operative to retain nail clippings during the nail clipping process.

Another object of this invention is to provide a nail clipper in accordance with the preceding objects and constructed in a manner whereby the clipper may be maintained in a closed position after a nail clipping operation has been completed retaining all of the nail clippings made during the nail clipping operation therein.

Still another important object of this invention is to provide a nail clipper of the conventional type, but which does not include a center post for pivotally and rotatably mounting the actuating lever of the nail clipper and which therefore enables longer sections of nails to be clipped without interference with a conventional lever mounting post.

A final object of this invention to be specifically enumerated herein is to provide an improved nail clipper in accordance with the preceding objects and which will conform to conventional forms of manufacture, be of simple construction and easy to use so as to provide a device that will be economically feasible, long lastng and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
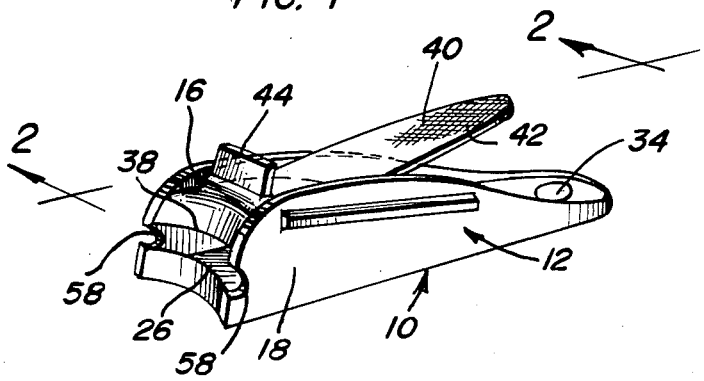
FIG. 1 is a perspective view of the improved nail clipper construction of the instant invention.
Figure 3:
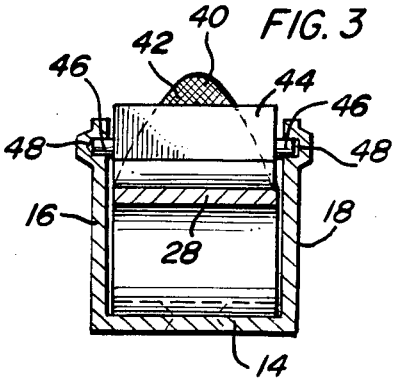
FIG. 3 is a transverse vertical sectional view taken substantially upon the plane indicated by the section line 3—3 of FIG. 2.

Referring now more specifically to the drawings the numeral 10 generally designates the improved nail clipper construction of the instant invention. The construction 10 includes a channel-shaped body referred to in general by the reference numeral 12 and including a longitudinally extending base plate or bright portion 14 upwardly from whose opposite longitudinal side edges opposite side flanges 16 and 18 project.

The body 12 includes front and rear ends 20 and 22 and the front end of the body 14 includes an upwardly projecting transverse integral blade member 24 including a beveled upper cutting edge 26 which is longitudinally arcuate and concave in forward direction.

The clipper construction 10 further includes a spring arm 28 including front and rear ends 30 and 32. The spring arm front and rear ends are slightly relatively angulated and the rear end 32 is secured to the rear end 22 through the utilization of a rivet 34. The front end of the spring arm 28 includes a depending blade member 36 opposing and corresponding to the blade member 34. The blade member 36 includes a cuting edge 38 and downward displacement of the front end 30 of the spring arm 28 and movement of the cutting edges 26 and 28 into cooperative cutting relation with each other is sufficient to clip fingernails and toenails.

The clipper construction 10 additionally includes a generally L-shaped lever 40 including relatively angulated long and short arms 42 and 44.

The arm 44 includes mid-length opposite side laterally outwardly projecting pivot pin portions 46 carried by the slidably and rotatably received in inwardly opening opposed longitudinally extending and inclined grooves 48 formed in the flanges 16 and 18. In addition, the opposite ends of the grooves 48 are upwardly enlarged as at 50.

Figure 2:
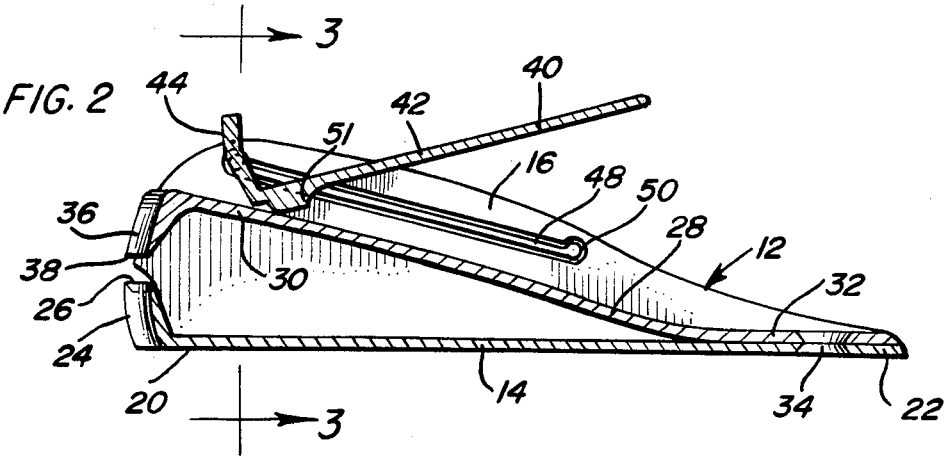
FIG. 2 is an enlarged longitudinal vertical sectional view taken substantially upon the plane indicated by the section line 2—2 of FIG. 1.

The pivot pin portions 46 pivotally and slidably support the lever 40 between the flanges 16 and 18 and when the pivot pin portions 46 are disposed in the forward enlarged end portions of the grooves 48 the first end portion of the lever 40 may be swung downwardly in order to allow the heel portion 51 of the lever to downwardly displace the front end 30 of the support arm 38 from its static position illustrated in FIG. 2 of the drawings toward a lowered position with the cutting edge 38 engaged with the cutting edge 26 in order to cut portions of nails disposed therebetween. As a nail is clipped the clipped portions 52 of the nail are received within the area 54 within the clipper construction 10 defined between the flanges 18 and between the base plate 14 and the spring arm 28. In this manner, the clippings 52 are retained and do not fall to the ground.

Figure 4:
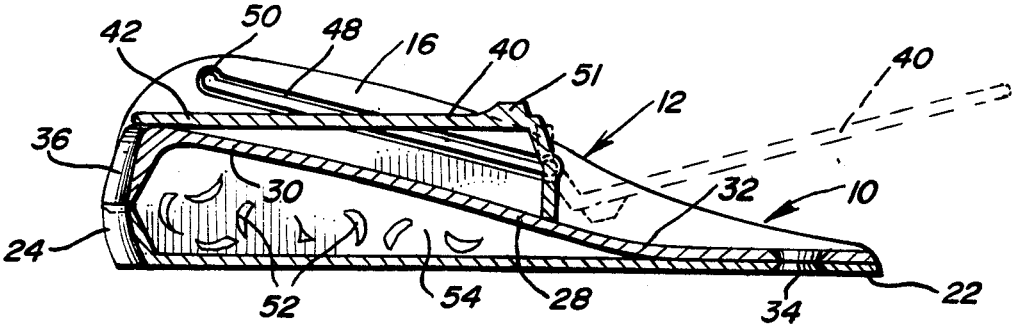
FIG. 4 is a longitudinal vertical sectional view similar to FIG. 2 but with the nail clipper in a fully closed nail clipping retaining condition, an alternate position of the actuating lever of the clipper being illustrated in phantom lines.

When a clipping operation has been completed, the lever 40 may have the long arm 42 thereof swung slightly upwardly from the position thereof illustrated in FIG. 2. The lever 40 then may be slid from the forwardly displaced position of FIG. 2 toward the rearmost limit position thereof with the pivot pin portions 46 received in the rear enlarged portions 50 of the grooves 48 (note the phantom line position of the lever 40 illustrated in FIG. 4). Thereafter, the lever 40 may be swung from the phantom line position of FIG. 4, past a vertical center position, to the solid line position thereof illustrated in FIG. 4 in order to not only retract the lever 40 to a position substantially fully received between the flanges 16 and 18, but also to downwardly depress the front end 30 of the spring arm 28 so as to again close the area 54 and thus assure retention of the clippings 52 therein.

The opposite ends of the cutting edges 26 and 38 terminate at the forward end portions of the flanges or sides 16 and 18 and the sides 16 and 18 include forward end notches 58 formed therein opening endwise outwardly of the front ends of the flanges 16 and 18 at a level spaced immediately above the cutting edge 26. The notches 58 enable nails wider than the clipper construction 10 to be readily clipped.

Inasmuch as the clipper construction 10 does not include the usual post from which the lever member corresponding to the lever member 40 of conventional clippers is rotatably and pivotally mounted, the area 54 is totally unobstructed and may thus receive and retain a greater number of nail clippings 52. In addition, the clipper 10 may receive nails therein of substantial length without interference of such nails with the aforementioned conventional post found on other clippers.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A nail clipper including a first elongated upwardly opening channel member having front and rear ends, said channel member having front and rear ends, said channel member including a pair of generally parallel elongated opposite side flanges interconnected along their lower marginal edge portions by a generally horizontal bight portion extending therebetween, the front end of said bight portion including an upwardly projecting and transversely extending first cutting blade portion, an elongated spring arm generally paralleling said channel member, having front and rear ends and constructed of stiff but resilient material, means anchoring said spring arm rear end to the rear end of said bight portion with the front end of said spring arm spaced above and opposing the front end of said bight portion, said spring arm front end including a transversely extending second cutting blade portion depending downwardly therefrom, said front end of said spring arm being statically disposed in an elevated position with said second cutting blade portion opposing and spaced above said first cutting blade portion, said spring arm front end being downwardly displaceable, upon flexing of said spring arm, to a position with said first and second cutting blade portions disposed in opposing cooperative cutting relation, convertible lever means, said lever means and flanges including coacting means pivotally mounting said lever betweens said flanges for oscillation relative to said channel member about an axis extending transversely of said lever means and channel member and for shifting of said axis longitudinally of said channel member between forward and rearward limit positions thereon, said lever means comprising a generally L-shaped lever including relatively angulated long and short arms, said axis being fixed relative to said lever and extending transversely of said short arm centrally intermediate the opposite ends thereof, said lever when in said forward limit position, being disposed with the free end of said long arm projecting rearwardly and being operative as a second class lever to depress the front end of said spring arm into position with said first and second cutting blade portions in cooperative cutting relation and, when in said rear limit position, being swingable about said axis past a center vertical position to a position with the free end of said long arm projecting forwardly and said lever operative as a first class lever, with the free ends of said long and short arms engaged with and spring arm, to maintain said front end of said spring arm displaced toward said first cutting blade portion with said first and second cutting blade portions at least closely opposing each other and said channel member and spring arm defining a substantially closed area between said flanges and between said bight portion and spring arm for containing nail cuttings.

2. A nail clipper including a first elongated upwardly opening channel member having front and rear ends, said channel member including a pair of generally parallel elongated opposite side flanges interconnected along their lower marginal edge portions by a generally horizontal bight portion extending therebetween, the front end of said bight portion including an upwardly projecting and transversely extending first cutting blade portion, an elongated spring arm generally paralleling said channel member, having front and rear ends and constructed of stiff but resilient material, means anchoring said arm rear end to the rear end of said bight portion with the front end of said arm spaced above and opposing the front end of said bight portion, said arm front end including a transversely extending second cutting blade portion depending downwardly therefrom, said front end of said arm being statically disposed in an elevated position with said second cutting blade portion opposing and spaced above said first cutting blade portion, said arm front end being downwardly displaceable, upon flexing of said arm, to a position with said first and second cutting blade portions disposed in opposing cooperative cutting relation, convertible lever means, said lever means and flanges including coacting means pivotally moounting said lever between said flanges for oscillation relative to said channel member about an axis extending transversely of said lever means and channel member and for shifting of said axis longitudinally of said channel member between forward and rearward limit positions thereon, said lever means, when in said forward limit position, being operative as a second class lever to depress the front end of said arm into position with first and second cutting blade portions in cooperative cutting relation and further operative, when in said rear limit position, as a first class lever to maintain said front end of said arm displaced toward said first cutting blade portion with said first and second cutting blade portions at least closely opposing each other and said channel member and arm defining a substantially closed area between said flanges and between said bight portion and arm for containing nail cuttings, said coacting means including inwardly opening grooves formed in and extending along the side flanges of said channel member and outwardly projecting opposite side pivot pin portions carried by said lever means pivotally and slidably received in said groove.

3. The nail clipper of claim 2 wherein the opposite ends of said grooves include slightly laterally upwardly projecting enlargements in which said pin portions may be seated.

4. The nail clipper of claim 1 wherein said cutting blade portions are forwardly concave.

5. The nail clipper of claim 1 wherein said flanges terminate forwardly at the opposite ends of said first cutting blade portion.

6. The nail clipper of claim 5 wherein said flanges include forward end forwardly opening notches disposed immediately above said first cutting blade portion.

7. The nail clipper of claim 6 wherein said cutting blade portions are forwardly concave.

8. A nail clipper including a first elongated upwardly opening channel member having front and rear ends, said channel member including a pair of generally parallel elongated opposite side flanges interconnected along their lower marginal edge portions by a generally horizontal bight portion extending therebetween, the front end of said bight portion including an upwardly projecting and transversely extending first cutting blade portion, an elongated spring arm generally paralleling said channel member, having front and rear ends and constructed of stiff but resilient material, means anchoring said arm rear end to the rear end of said bight portion with the front end of said arm spaced above and opposing the front end of said bight portion, said arm front end including a transversely extending second cutting blade portion depending downwardly therefrom, said front end of said arm being statically disposed in an elevated position with said second cutting blade portion opposing and spaced above said first cutting blade portion, said arm front end being downwardly displaceable, upon flexing of said arm, to a position with said first and second cutting blade portions disposed in opposing cooperative cutting relation, convertible lever means, said lever means and flanges including coacting means pivotally mounting said lever between said flanges for oscillation relative to said channel member about an axis extending transversely of said lever means and channel member and for shifting of said axis longitudinally of said channel member between blade portions in cooperative cutting relation and further operative, when in said rear limit position, as a first class lever to maintain said front end of said arm displaced toward said first cutting blade portion with said first and second cutting blade portions at least closely opposing each other and said channel member and arm defining a substantially closed area between said flanges and between said bight portion and arm for containing nail cuttings, said flanges terminating forwardly at the opposite ends of said first cutting blade portion, said flanges including forward end forwardly opening notches disposed immediately above said first cutting blade portion, said cutting blade portions being forwardly concave, said coacting means including inwardly opening grooves formed in and extending along the side flanges of said channel member and outwardly projecting opposite side pivot pin portions carried by said lever means pivotally and slidably received in said grooves.

9. The nail clipper of claim 8 wherein the opposite ends of said grooves include slightly laterally upwardly projecting enlargements in which said pin portions may be seated.

* * * * *